US011769642B2

(12) United States Patent
Doro

(10) Patent No.: US 11,769,642 B2
(45) Date of Patent: Sep. 26, 2023

(54) PUSH SWITCH AND ILLUMINATED SWITCH DEVICE

(71) Applicant: Panasonic Intellectual Property Management Co., Ltd., Osaka (JP)

(72) Inventor: Kunio Doro, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 111 days.

(21) Appl. No.: 17/602,534

(22) PCT Filed: Feb. 17, 2020

(86) PCT No.: PCT/JP2020/006118
§ 371 (c)(1),
(2) Date: Oct. 8, 2021

(87) PCT Pub. No.: WO2020/208940
PCT Pub. Date: Oct. 15, 2020

(65) Prior Publication Data

US 2022/0172909 A1 Jun. 2, 2022

(30) Foreign Application Priority Data

Apr. 10, 2019 (JP) ..... 2019-075148

(51) Int. Cl.
*H01H 13/83* (2006.01)
*H01H 13/02* (2006.01)
(Continued)

(52) U.S. Cl.
CPC ..... *H01H 13/023* (2013.01); *F21V 13/04* (2013.01); *H01H 13/52* (2013.01)

(58) Field of Classification Search
CPC ..... H01H 13/83; H01H 3/125; H01H 13/705; H01H 13/14; H01H 13/04; H01H 13/10;
(Continued)

(56) References Cited

U.S. PATENT DOCUMENTS 8,729,413 B2 * 5/2014 Nakaoka ..... H01H 13/88 200/512
2007/0039809 A1 2/2007 Aihara et al.
(Continued)

FOREIGN PATENT DOCUMENTS

JP 2007-053063 A 3/2007
JP 2009-123183 A 6/2009
(Continued)

OTHER PUBLICATIONS

International Search Report and Written Opinion issued in International Patent Application No. PCT/JP2020/006118, dated May 12, 2020; with partial English translation.

*Primary Examiner* — Ahmed M Saeed
(74) *Attorney, Agent, or Firm* — McDermott Will & Emery LLP

(57) ABSTRACT

A push switch includes a case, a fixed contact member, a moving contact member, and a protective sheet. The case has a first surface with a recess and a second surface opposite from the first surface. The fixed contact member includes a fixed contact in the recess and a terminal on an outer surface of the case. The moving contact member is in the recess and includes a moving contact to contact with the fixed contact when the switch is subjected to a press operation. The protective sheet covers the recess. The case has a light-transmitting property and has a light incident surface and a light emergent surface. Light is incident on the light
(Continued)

incident surface. At least part of the light that has entered through the light incident surface emerges through the light emergent surface.

12 Claims, 11 Drawing Sheets

(51) Int. Cl.
*F21V 13/04* (2006.01)
*H01H 13/52* (2006.01)

(58) Field of Classification Search
CPC .. H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 2007/0062794 | A1* | 3/2007 | Rainer | H01H 13/023 200/314 |
| 2009/0052155 | A1* | 2/2009 | Tang | H01H 13/83 362/23.05 |
| 2009/0128496 | A1 | 5/2009 | Huang et al. | |
| 2013/0062170 | A1 | 3/2013 | Takeuchi et al. | |
| 2014/0008188 | A1* | 1/2014 | Sakamoto | H01H 13/83 200/311 |
| 2014/0318938 | A1 | 10/2014 | Takeuchi et al. | |
| 2017/0316901 | A1 | 11/2017 | Sawada et al. | |
| 2019/0080864 | A1 | 3/2019 | Sawada et al. | |

FOREIGN PATENT DOCUMENTS

| | | | |
|---|---|---|---|
| JP | 2013-058380 | A | 3/2013 |
| WO | 2016/075907 | A1 | 5/2016 |

* cited by examiner

PUSH SWITCH AND ILLUMINATED SWITCH DEVICE

CROSS-REFERENCE OF RELATED APPLICATIONS

This application is the U.S. National Phase under 35 U.S.C. § 371 of International Patent Application No. PCT/JP2020/006118, filed on Feb. 17, 2020, which in turn claims the benefit of Japanese Application No. 2019-075148, filed on Apr. 10, 2019, the entire disclosures of which Applications are incorporated by reference herein.

TECHNICAL FIELD

The present disclosure generally relates to a push switch and an illuminated switch device. More particularly, the present disclosure relates to a push switch and an illuminated switch device, both of which are configured to turn ON/OFF depending on whether or not a press operation is performed thereon.

BACKGROUND ART

A push switch is disclosed in Patent Literature 1. The push switch is formed by covering, with a protective sheet, the top of a case on which a switch contact portion is provided. The protective sheet is welded and fixed to the case by laser irradiation. Specifically, the part to be welded and fixed onto the case is defined as a partially linear region within a range corresponding to an adhesive margin of the protective sheet.

The push switch is widely used in onboard equipment and keyboards of personal computers, for example. In particular, nowadays, an increasing number of push switches have been provided which are designed to illuminate their part around a key top so as to allow the user to operate them even in the dark.

However, the known push switches tend to cause uneven illumination and have insufficient illuminability.

CITATION LIST

Patent Literature

Patent Literature 1: JP 2013-058380 A

SUMMARY OF INVENTION

An object of the present disclosure is to provide a push switch and an illuminated switch device, both of which contribute to improving illuminability.

A push switch according to an aspect of the present disclosure includes a case, a fixed contact member, a moving contact member, and a protective sheet. The case has a first surface provided with a recess and a second surface opposite from the first surface. The fixed contact member includes a fixed contact arranged in the recess and a terminal arranged on an outer surface of the case. The moving contact member is arranged in the recess and includes a moving contact that comes into contact with the fixed contact when the push switch is subjected to a press operation. The protective sheet covers the recess. The case has a light-transmitting property. The case has a light incident surface and a light emergent surface. The light incident surface is a surface on which light is incident. The light emergent surface is a surface through which at least part of the light that has entered through the light incident surface emerges.

An illuminated switch device according to another aspect of the present disclosure includes the push switch and a light source. The light source emits light toward the light incident surface of the push switch.

DESCRIPTION OF EMBODIMENTS

(1) First Embodiment

(1.1) Overview

First, a push switch 1 according to a first embodiment will be described with reference to the drawings. The push switch 1 according to this embodiment is implemented as what is called an "illuminated switch". The push switch 1 is used as an operating member of various devices such as mobile telecommunications devices, onboard equipment, and consumer electronic appliances. The push switch 1 is built in the housing of a device, for example, in a state where the push switch 1 is mounted on a printed circuit board. In that case, an operating button, for example, is arranged at a position corresponding to the push switch 1 in the housing. This allows the push switch 1 to be indirectly operated via the operating button by having the user press the operating button.

Figure 1:
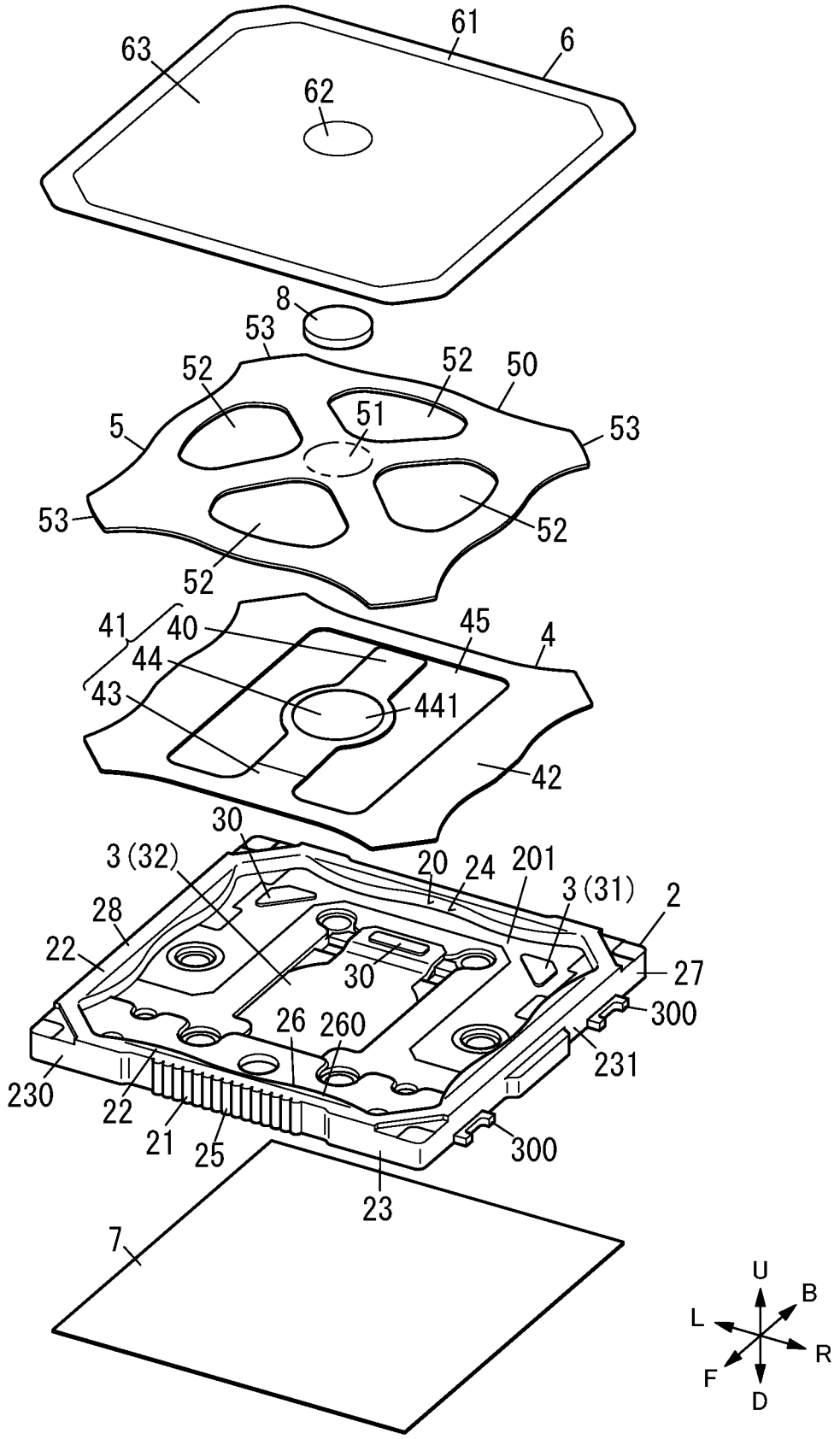
FIG. 1 is an exploded perspective view of a push switch according to a first embodiment.

As shown in FIG. 1, the push switch 1 includes a case 2, a fixed contact member 3, a moving contact member 4, and a protective sheet 6.

The case 2 has a light-transmitting property. The case 2 has a light incident surface 21 and a light emergent surface 22. The light incident surface 21 is a surface on which light is incident. The light emergent surface 22 is a surface through which at least a part of the incident light emerges. The case 2 has a first surface 201 and a second surface 202.

The first surface 201 is provided with a recess 20. Accordingly, the case 2 has the recess 20. The second surface 202 is a surface opposite from the first surface 201.

The fixed contact member 3 includes fixed contacts 30 and terminals 300. The fixed contacts 30 are arranged in the recess 20. The terminals 300 are arranged on the outer surfaces of the case 2.

The moving contact member 4 includes a moving contact 40. The moving contact 40 is arranged in the recess 20 and comes into contact with the fixed contacts 30 when subjected to a press operation.

Figure 2:
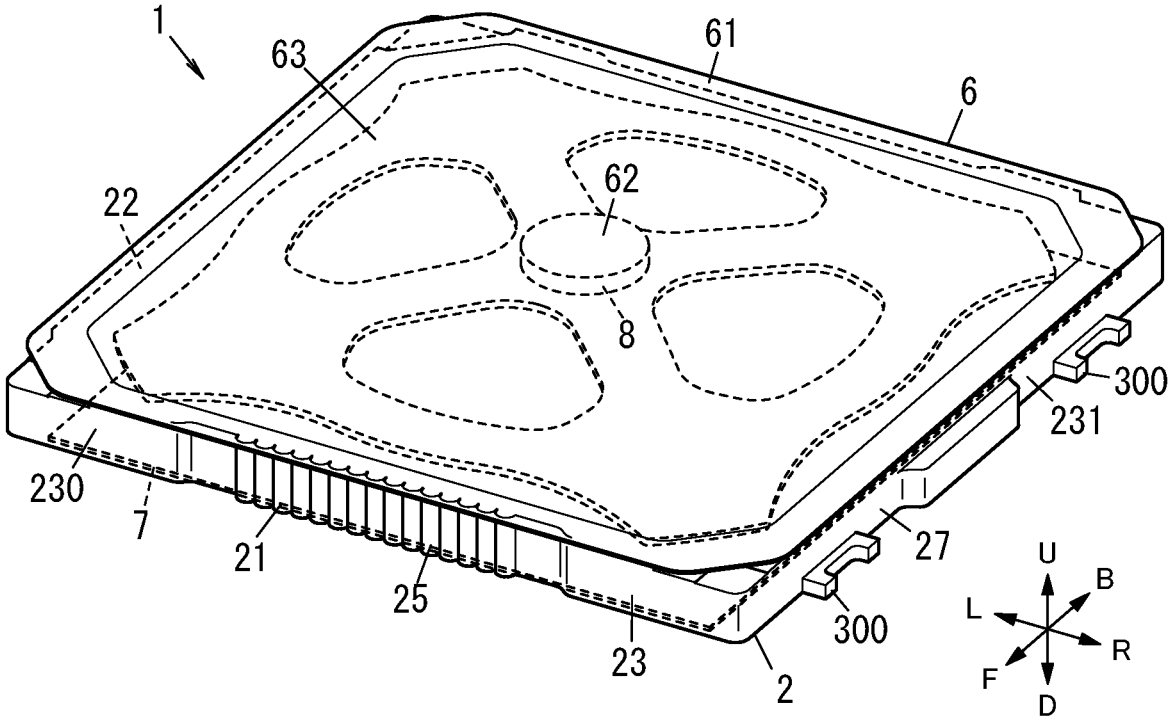
FIG. 2 is a perspective view of the push switch.

The protective sheet 6 covers the recess 20 (see FIG. 2).

The push switch 1 according to this embodiment may improve the illuminability of the push switch 1 by having the case 2 function as a light guide member.

(1.2) Details (1.2.1) Push Switch

In the following description, unless otherwise stated, a direction perpendicular to the first surface 201 of a base member 27 will be hereinafter referred to as an "upward/downward direction." One side, defined in the upward/downward direction by the first surface 201, of the base member 27 will be hereinafter referred to as "upside", while the other side, defined in the upward/downward direction by the second surface 202 opposite from the first surface 201, of the base member 27 will be hereinafter referred to as "downside." The "direction in which the press operation is performed" is the "upward/downward direction." The direction in which the terminals 300 protrude from the case 2 will be hereinafter defined as a "rightward/leftward direction," and the direction perpendicular to both the upward/downward direction and the rightward/leftward direction will be hereinafter defined as the "forward/backward direction." In this description, the upward, downward, leftward, rightward, forward, and backward directions are defined just as respectively indicated by the "U," "D," "L," "R," "F," and "B" arrows in FIG. 1 and other drawings. Note that these arrows indicating the respective directions do not define the directions in which the push switch 1 should be used but are just shown there as an assistant to description and are insubstantial ones.

As shown in FIG. 1, the push switch 1 includes the case 2, the fixed contact member 3 (including a first fixed contact member 31 and a second fixed contact member 32 in this embodiment), the moving contact member 4, a moving member 5, the protective sheet 6, a diffuse reflection layer 7, and a presser 8. In the following description, unless otherwise stated, a state in which the push switch 1 is not operated (i.e., a state in which the push switch 1 is not pressed) will be described.

<Case>

The case 2 has a light-transmitting property. In other words, the case 2 has the property of transmitting visible light. The degree of transparency of the case 2 is not particularly limited. The case 2 may be colorless or colored as long as the case 2 is transparent or semitransparent. In addition, the case 2 has electrical insulation properties. The case 2 is made of a resin or a ceramic.

The case 2 has the shape of a rectangular parallelepiped which is compressed in the upward/downward direction. The case 2 includes the base member 27 and a peripheral wall 28.

The base member 27 has a plate shape. The base member 27 is formed in a rectangular shape in a top view.

Figure 3:
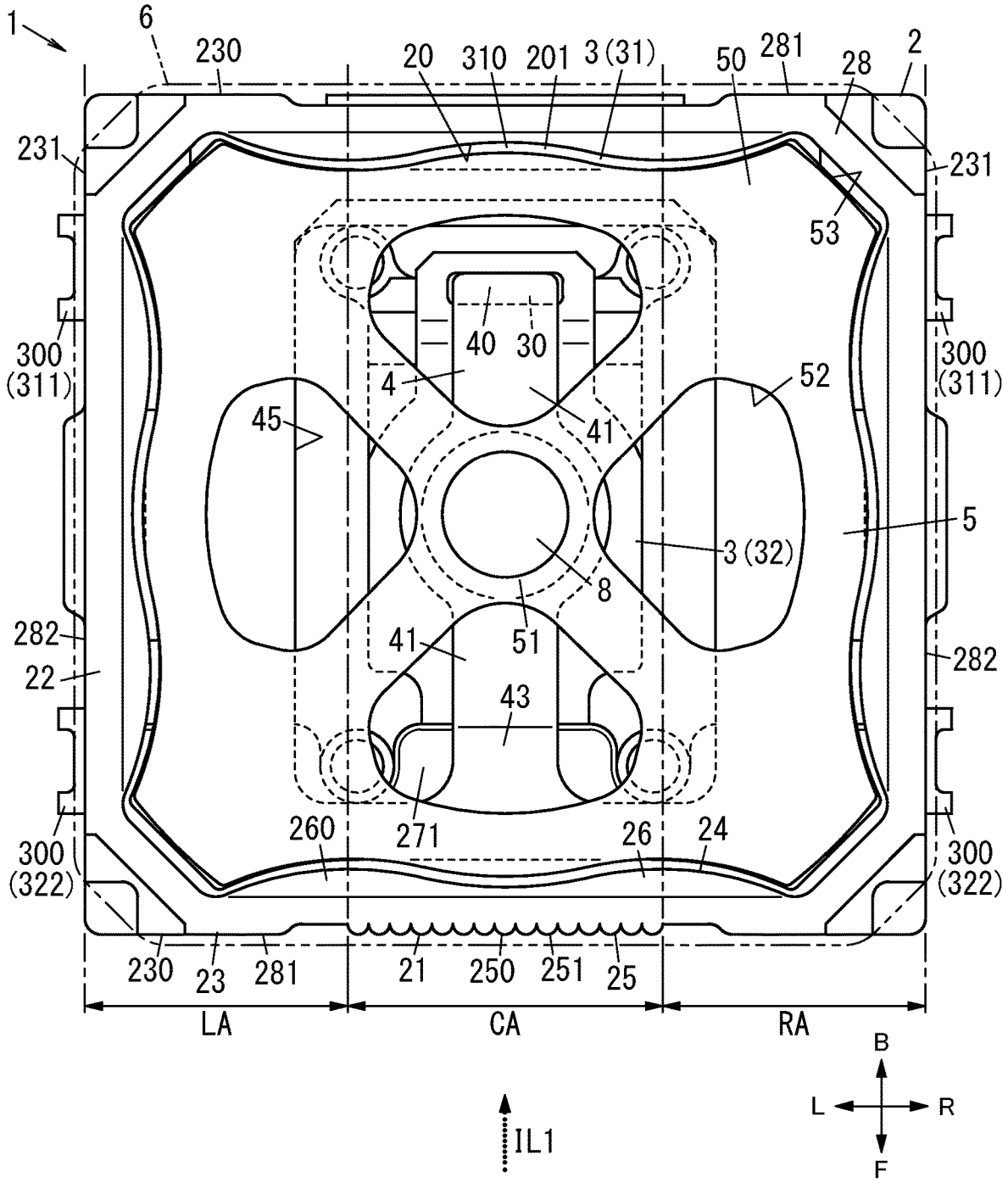
FIG. 3 is a plan view of the push switch.

The peripheral wall 28 protrudes upward from the outer periphery of the first surface 201 of the base member 27. The peripheral wall 28 is formed in a rectangular frame shape in a top view. As shown in FIG. 3, the peripheral wall 28 is made up of two wall portions 281 and two more wall portions 282. The two wall portions 281 face each other in the forward/backward direction. The two wall portions 282 face each other in the rightward/leftward direction.

The case 2 has the recess 20. The recess 20 is opened upward. The opening shape of the recess 20 is a generally square shape. The recess 20 is provided on the first surface 201. Specifically, the recess 20 is a space surrounded by the first surface 201 of the base member 27 and inner surfaces 24 of the peripheral wall 28. The first surface 201 of the base member 27 is the bottom surface of the recess 20. The inner surfaces 24 of the peripheral wall 28 are the inner surfaces of the recess 20.

The recess 20 is formed to have curved inner surfaces 24 such that a middle portion of each of the four sides projects outward in a top view. In addition, the recess 20 is also formed to have curved inner surfaces 24 such that four corners thereof project outward in a top view.

Figure 4:
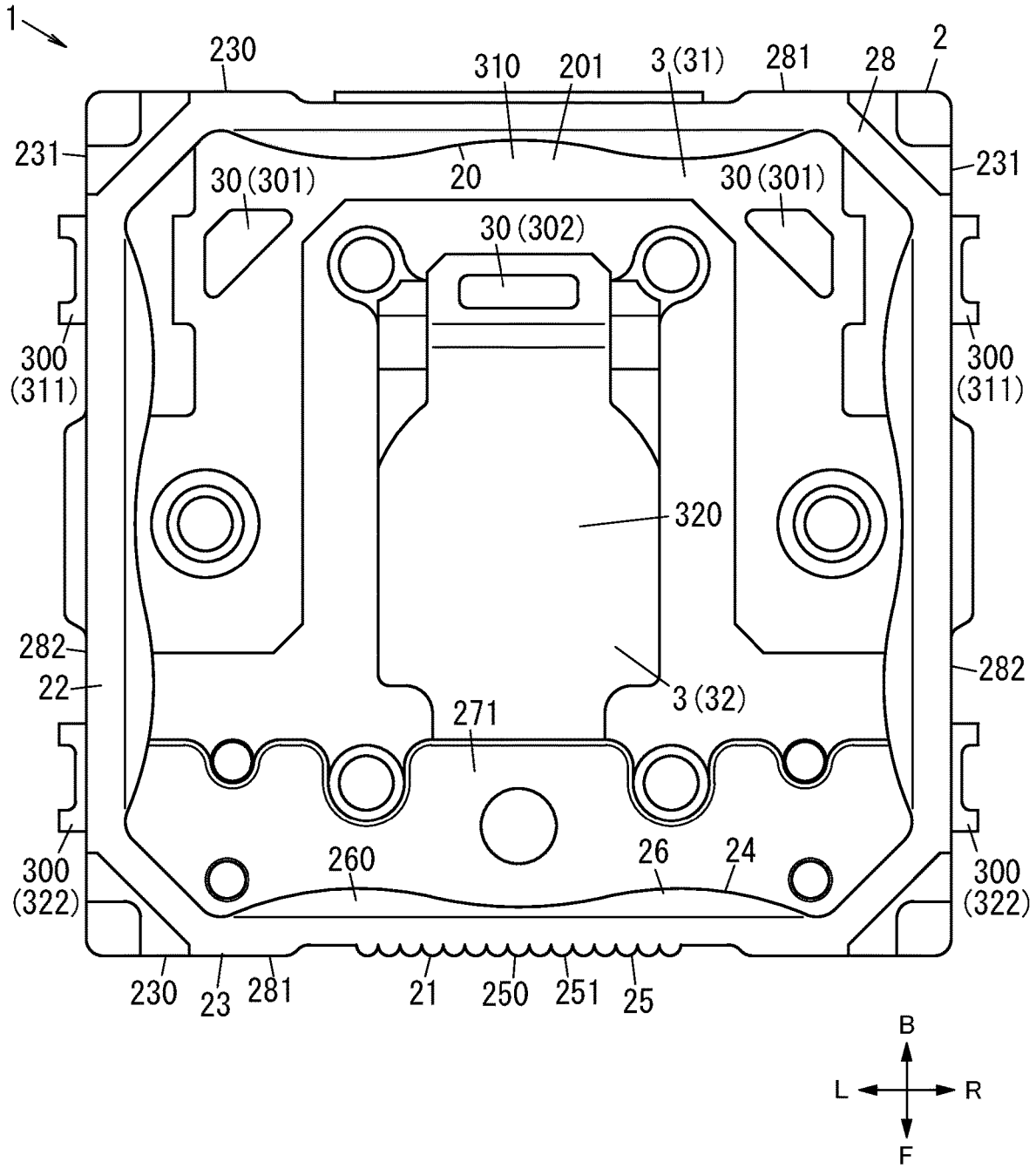
FIG. 4 is a plan view of the push switch, from which a protective sheet, a presser, a moving member, and a moving contact member are removed.
Figure 5:
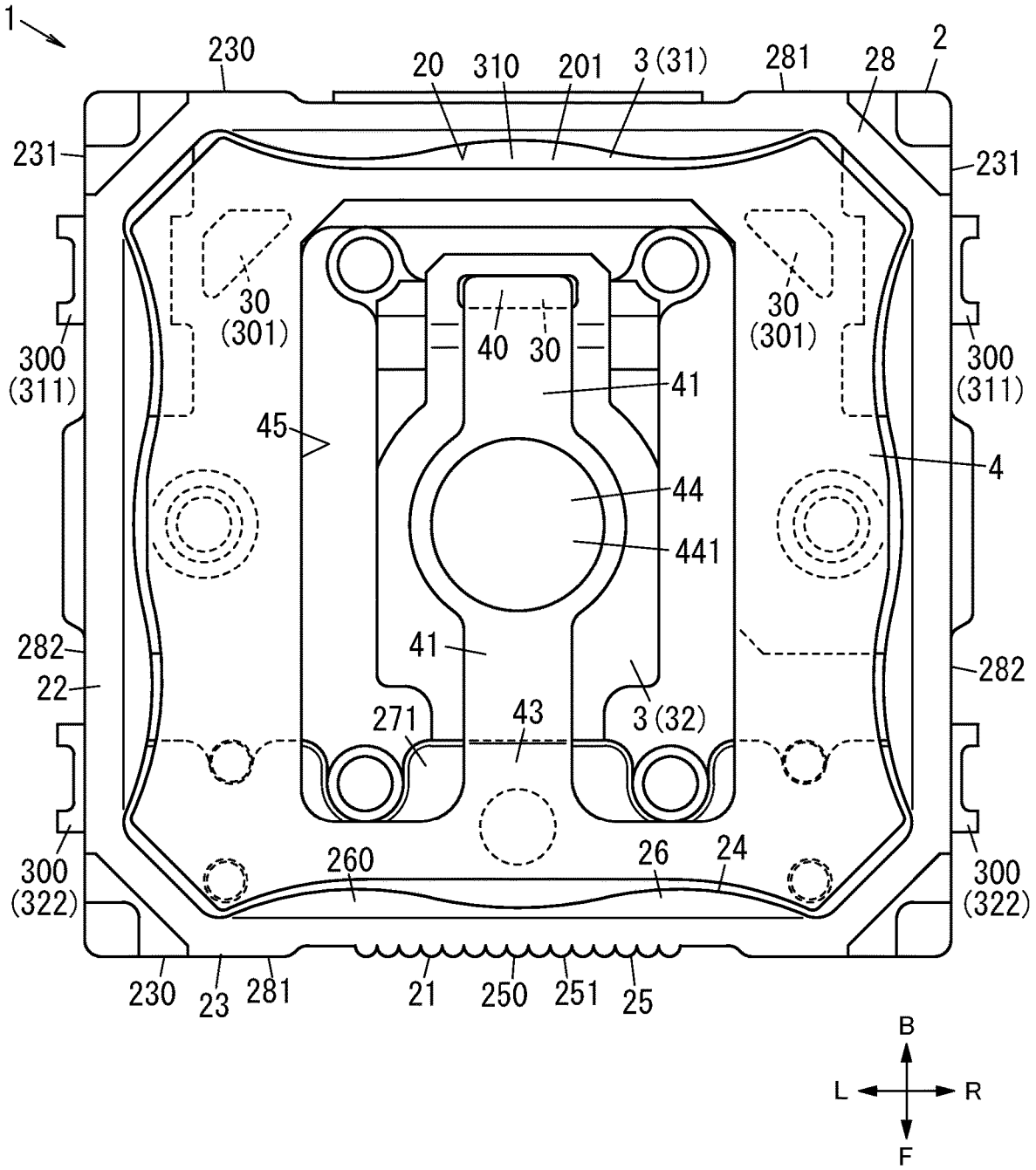
FIG. 5 is a plan view of the push switch, from which the protective sheet, the presser, and the moving member are removed.

As shown in FIG. 4, the base member 27 includes a support base 271. The support base 271 is located at the frontend of the bottom surface of the recess 20 (first surface 201). The support base 271 protrudes upward from the first surface 201. As shown in FIG. 5, the support base 271 is a part for supporting a supporting portion 43 of a contact piece 41 of the moving contact member 4.

The case 2 has the light incident surface 21 and the light emergent surface 22. The light incident surface 21 is a surface on which light is incident. The light emergent surface 22 is a surface through which at least part of the light that has entered through the light incident surface 21 emerges. Of the surfaces of the case 2, at least one of the surfaces serves as the light incident surface 21, while at least some (or even all) of the other surfaces serve as the light emergent surface(s) 22. Light enters the case 2 through the light incident surface 21. Next, the light is propagated inside the case 2 by being totally reflected a number of times, and then emerges out of the case 2 through the light emergent surface 22. In this manner, the case 2 functions as a light guide member.

In this embodiment, the light incident surface 21 is provided as an outer surface 23 of the case 2. The outer surface 23 of the case 2 is a surface connecting the first surface 201 and the second surface 202 of the case 2. Specifically, as shown in FIG. 3, the light incident surface 21 is provided as the outer surface 23 of the front wall portion 281 out of the two wall portions 281 facing each other in the forward/backward direction. This allows the light to be incident between the first surface 201 and the second surface 202.

The case 2 has a light diffusion structure 25. The light diffusion structure 25 is provided for the light incident surface 21. The light diffusion structure 25 causes the incident light to diffuse within a plane perpendicular to the direction in which the press operation is performed (i.e., the upward/downward direction). As shown in FIG. 3, the light diffusion structure 25 is configured as a lens group 250 (lens array). The lens group 250 includes a plurality of unit lenses 251. The plurality of unit lenses 251 are arranged side by side in the rightward/leftward direction. The unit lenses 251 may be, for example, prism lenses, cylindrical lenses, or Fresnel lenses.

The case 2 has a light reflection structure 26 on the light emergent surface 22. The light reflection structure 26 reflects light in a direction (i.e., the upward/downward direction) parallel to the direction in which the press operation is performed (i.e., the upward/downward direction). In this embodiment, the light emergent surface 22 having the light reflection structure 26 is provided as an inner surface 24 of the case 2. The light reflection structure 26 includes a tapered surface 260. The tapered surface 260 is connected to the upper surface of the front wall portion 281. The tapered surface 260 is sloped down toward the bottom surface of the recess 20 (first surface 201) from the upper surface of the front wall portion 281. Thus, the tapered surface 260 is sloped with respect to the direction in which the press operation is performed (i.e., the upward/downward direction).

In this embodiment, the light emergent surface 22 includes the upper surface of the peripheral wall 28 having the rectangular frame shape, out of the surfaces of the case 2. As can be seen, the light emergent surface 22 is provided for a surface with the recess 20 of the case 2 (i.e., the first surface 201). Note that the surfaces with the recess 20 of the case 2 include not only the inner surface 24 of the peripheral wall 28 and the upper surface of the peripheral wall 28, but also the bottom surface of the recess 20 (first surface 201).

<Fixed Contact Member>

The fixed contact member 3 is held by the base member 27 of the case 2. The fixed contact member 3 has electrical conductivity. For example, the fixed contact member 3 is formed of a metal plate. The fixed contact member 3 is integrated with the case 2 by insert molding, for example.

The fixed contact member 3 includes the fixed contacts 30 and the terminals 300. The fixed contacts 30 are arranged in the recess 20 of the case 2. The terminals 300 are arranged on the outer surface of the case 2.

In this embodiment, the fixed contact member 3 includes the first fixed contact member 31 and the second fixed contact member 32. The first fixed contact member 31 and the second fixed contact member 32 are arranged in the forward/backward direction. The first fixed contact member 31 is arranged backward of the second fixed contact member 32. The first fixed contact member 31 and the second fixed contact member 32 are electrically insulated from each other. At least part of the fixed contact member 3 has light reflectivity. Of the fixed contact member 3, a part which is not embedded in the case 2 has light reflectivity. The fixed contact member 3 may be imparted with light reflectivity by plating, for example.

As shown in FIG. 4, the first fixed contact member 31 includes a plurality of (e.g., two in this embodiment) first fixed contacts 301, a plurality of (e.g., two in this embodiment) first terminals 311, and a first body portion 310.

The first fixed contacts 301 are provided separately from second fixed contact 302. The first fixed contacts 301 are electrically insulated from the second fixed contact 302.

The first body portion 310 couples the two first terminals 311 together. The first body portion 310 has a generally U shape in a top view, which is formed by an elongate part extending in the rightward/leftward direction between the two first terminals 311 and a pair of parts that protrudes forward from both end portions of the elongate part. Of the first body portion 310, the base end portion (rear end portion) of each forwardly protruding portion has a partially raised upper surface. These raised portions constitute the first fixed contacts 301. Thus, a pair of such first fixed contacts 301 is provided for the first fixed contact member 31. The two first fixed contacts 301, the two first terminals 311, and the first body portion 310 are integrally formed of a metal plate and are electrically connected to each other.

The first fixed contact member 31 is held by the case 2 (base member 27) by having at least part of the first body portion 310 embedded in the case 2. The first body portion 310 is mostly exposed, along the peripheral wall 28, out of the bottom surface of the recess 20 (first surface 201). The upper surface of the part exposed on the first surface 201 of the first body portion 310 is flush with the first surface 201. Therefore, the two first fixed contacts 301, formed by having respective rear end portions of the upper surface of the first body portion 310 partially raised, protrude upward from the first surface 201 of the base member 27.

The two first terminals 311 are provided at both ends in the rightward/leftward direction of the first fixed contact member 31. The two first terminals 311 protrude from both side surfaces in the rightward/leftward direction of the case 2. Specifically, one first terminal 311 protrudes leftward from the left side surface of the case 2. Meanwhile, the other first terminal 311 protrudes rightward from the right side surface of the case 2.

The first terminals 311 are mechanically bonded and electrically connected, by soldering, to a conductive member on a board 100 such as a printed circuit board (see FIG. 9), for example.

As shown in FIG. 4, the second fixed contact member 32 includes the second fixed contact 302, a plurality of (e.g., two in this embodiment) second terminals 322, and a second body portion 320.

The second fixed contact 302 is located at a middle in the rightward/leftward direction of the second fixed contact member 32.

The second body portion 320 couples the two second terminals 322 together.

The second body portion 320 has a generally T shape in a top view, which is formed by an elongate part extending in the rightward/leftward direction between the two second terminals 322 and a part that protrudes backward from a middle portion of the elongate part. Of the second body portion 320, a tip portion (rear end portion) of backwardly protruding portion has a partially raised upper surface. This raised portion constitutes the second fixed contact 302. Thus, the second fixed contact 302, the two second terminals 322, and the second body portion 320 are integrally formed of a single metal plate and are electrically connected to each other.

The second fixed contact member 32 is held by the case 2 (base member 27) by having at least part of the second body portion 320 embedded in the case 2. The second fixed contact 302, formed by having the rear end portion of the upper surface of the second body portion 320 partially raised, protrudes upward from the first surface 201 of the base member 27 (see FIGS. 7 and 8).

The two second terminals 322 are provided at both ends in the rightward/leftward direction of the second fixed contact member 32. The two second terminals 322 protrude from both side surfaces in the rightward/leftward direction of the case 2. Specifically, one second terminal 322 protrudes leftward from the left side surface of the case 2. Meanwhile, the other second terminal 322 protrudes rightward from the right side surface of the case 2.

The second terminals 322 are mechanically bonded and electrically connected, by soldering, to a conductive member on a board 100 such as a printed circuit board (see FIG. 9), for example.

The left and right side surfaces of the case 2 are provided with the terminals 300 (i.e., the two first terminals 311 and the two second terminals 322), and therefore, each of the left and right side surfaces of the case 2 serves as a surface 231 with terminals. Meanwhile, each of the front and rear surfaces of the case 2 is provided with no terminals 300, and therefore, serves as a surface 230 with no terminals. Accordingly, the outer surface 23 of the case 2 includes the surfaces 231 with terminals and the surfaces 230 with no terminals. In this embodiment, the light incident surface 21 is provided as one of the surfaces 230 with no terminals.

<Moving Contact Member>

The moving contact member 4 is arranged in the recess 20 of the case 2. The moving contact member 4 has electrical conductivity and elasticity. For example, the moving contact member 4 is formed of a metal plate of stainless steel (SUS). At least part of the moving contact member 4 has light reflectivity. The moving contact member 4 may be imparted with light reflectivity by plating, for example.

As shown in FIG. 1, the moving contact member 4 has the contact piece 41 and a supporting frame 42.

The contact piece 41 includes the supporting portion 43, the moving contact 40, and a coupling portion 44. The supporting portion 43 is supported by the support base 271 of the base member 27 (see FIG. 5). The moving contact 40 moves from a position at which the moving contact 40 comes into contact with the second fixed contact 302 to a position at which the moving contact 40 goes out of contact with the second fixed contact 302, and vice versa (see FIGS. 7 and 8). The coupling portion 44 couples the supporting portion 43 and the moving contact 40 together.

The supporting frame 42 is formed in the shape of a rectangular frame with an opening 45. The opening 45 of the supporting frame 42 is formed in a rectangular shape which is elongated in the forward/backward direction. The lower surface of the supporting frame 42 comes into contact with the upper surface of the support base 271 and the respective upper surfaces of the two first fixed contacts 301. That is to say, the supporting frame 42 is supported, by the support base 271 and the two first fixed contacts 301, on the first surface 201 of the base member 27 to be generally parallel to the first surface 201. Therefore, the supporting frame 42 is constantly in contact with the two first fixed contacts 301.

The contact piece 41 protrudes along the first surface 201 of the base member 27 from a part of the supporting frame 42 so as to make the moving contact 40 face the second fixed contact 302 in the upward/downward direction. The contact piece 41 is formed in a cantilever shape. The contact piece 41 backwardly protrudes from the middle portion in the rightward/leftward direction of a frontend edge of the supporting frame's 42 opening 45. The contact piece 41 protrudes from the middle of a front one of the two sides, which face each other in the forward/backward direction, of the supporting frame 42 toward the rear side of the supporting frame 42. The supporting frame 42 and the contact piece 41 (including the supporting portion 43, the moving contact 40, and the coupling portion 44) are integrally formed of a single metal plate.

Of the contact piece 41, the frontend portion which is continuous with the supporting frame 42, i.e., the base end portion corresponding to the fixed end of a cantilever, constitutes the supporting portion 43. Meanwhile, the rear end portion of the contact piece 41, i.e., the tip portion corresponding to the free end of the cantilever, constitutes the moving contact 40. Of the contact piece 41, a part which faces the support base 271 in the upward/downward direction serves as the supporting portion 43, and a part which faces the second fixed contact 302 in the upward/downward direction serves as the moving contact 40. The rest of the contact piece 41 other than the supporting portion 43 and the moving contact 40 serves as the coupling portion 44. Of the contact piece 41, the coupling portion 44 and the moving contact 40 extends diagonally upward and backward from the supporting portion 43. The rest of the contact piece 41, other than the supporting portion 43, is sloped with respect to the first surface 201 such that as the distance to the tip (rear end) of the contact piece 41 decreases, the height of the contact piece 41 as measured from the bottom surface of the recess 20 (first surface 201) increases. Therefore, flexing the coupling portion 44 of the contact piece 41 allows the moving contact 40 to move from a position at which the moving contact 40 comes into contact with the second fixed contact 302 to a position at which the moving contact 40 goes out of contact with the second fixed contact 302, and vice versa (see FIGS. 7 and 8).

The coupling portion 44 includes a projection 441 which protrudes, in the upward/downward direction, away from the first surface 201 of the base member 27, i.e., upward. The projection 441 is located in a central area of the first surface 201 of the base member 27. The projection 441 is formed in a circular shape in a top view. The coupling portion 44 has, in the vicinity of the projection 441, a larger dimension in the rightward/leftward direction (width dimension) than the other portions.

The four corners of the supporting frame 42 are formed so as to protrude in four directions, in a top view, from the outer peripheral edges of the supporting frame 42. The moving contact member 4 is housed in the recess 20 so as to make the four corners of the supporting frame 42 fall inside the four outwardly projecting corners of the recess 20. Therefore, the four corners of the supporting frame 42 come into contact with respective parts of the inner surface 24 of the recess 20, thereby regulating the movement of the moving contact member 4 within a plane aligned with the first surface 201 of the base member 27.

The moving contact member 4 is constantly electrically connected to the two first fixed contacts 301 by keeping the lower surface of the supporting frame 42 in contact with the two first fixed contacts 301.

<Moving Member>

The moving member 5 is arranged in the recess 20 of the case 2. The moving member 5 is laid on top of the moving contact member 4. The moving member 5 has elasticity. For example, the moving member 5 is formed of a metal plate of stainless steel (SUS).

The moving member 5 includes a body portion 50 and four leg portions 53.

The body portion 50 is formed in a curved dome shape so that a central portion thereof is convex upward. The body portion 50 includes a pressure receiving portion 51 and a plurality of (e.g., four in this embodiment) through holes 52. The four through holes 52 have the same shape. The four through holes 52 are arranged, around the pressure receiving portion 51, at regular intervals along the circumference of the pressure receiving portion 51. The four through holes 52 penetrate in the upward/downward direction through the moving member 5. The four through holes 52 are respectively arranged in front, on the back, on the left, and on the right of the pressure receiving portion 51. The four through holes 52 are arranged symmetrically with respect to the center lines drawn in the forward/backward direction and rightward/leftward direction of the moving member 5.

The pressure receiving portion 51 is located in a central area of the body portion 50. When the push switch 1 is operated, the pressure receiving portion 51 receives force which is applied to the push switch 1 from outside of the push switch 1 (hereinafter sometimes referred to as "operating force").

The four leg portions 53 protrude obliquely downward from the outer peripheral edges of the body portion 50. The four leg portions 53 are arranged, in a top view, at regular intervals along the circumference of the body portion 50 so as to protrude in four directions from the outer peripheral edges of the body portion 50. The body portion 50 and the four leg portions 53 are continuous with each other. The moving member 5 is housed in the recess 20 so as to make the four leg portions 53 fall inside the four outwardly projecting corners of the recess 20. Therefore, the four leg portions 53 come into contact with respective parts of the inner surface 24 of the recess 20, thereby regulating the movement of the moving member 5 within a plane aligned with the first surface 201 of the base member 27.

In a state where the moving member 5 is housed in the recess 20 along with the moving contact member 4, the moving member 5 is in contact with the moving contact member 4 at only the respective tip portions of the four leg portions 53, and the rest of the moving member 5 other than the tip portions of the four leg portions 53 is out of contact with the moving contact member 4.

At least part of the moving member 5 has light reflectivity. The moving member 5 may be imparted with light reflectivity by plating, for example.

In this embodiment, as shown in FIG. 3, the rear through hole 52 out of the four through holes 52 of the moving member 5 is arranged at a position at which the through hole 52 faces the moving contact 40 in the upward/downward direction.

<Protective Sheet>

The protective sheet 6 has a light-transmitting property. In other words, the protective sheet 6 has the property of transmitting visible light. The degree of transparency of the protective sheet 6 is not particularly limited. The protective sheet 6 may be colorless or colored as long as the protective sheet 6 is transparent or semitransparent. In addition, the protective sheet 6 has flexibility, heat resistance, and electrical insulation properties. The protective sheet 6 is made of, for example, a resin.

The protective sheet 6 is arranged on the upper surface of the case 2 (opening of the recess 20) so as to cover the entire recess 20. The protective sheet 6 closes the recess 20 by being bonded to a peripheral portion, surrounding the recess 20, of the case 2, i.e., the upper surface of the peripheral wall 28 of the case 2. This reduces the chances of dust, dirt, and other foreign particles entering the recess 20, thereby protecting the respective members housed in the recess 20. The outer peripheral shape of the protective sheet 6 is generally the same as the outer peripheral shape of the peripheral wall 28 of the case 2.

The protective sheet 6 includes a bonding portion 61, a pressing portion 62, and an intermediate portion 63. The protective sheet 6 is bonded to the peripheral wall 28 of the case 2 along the bonding portion 61. In addition, the protective sheet 6 closes the recess 20 with the pressing portion 62 and the intermediate portion 63.

The bonding portion 61 is bonded to the upper surface of the peripheral wall 28. The bonding portion 61 is a rectangular frame portion that forms the outer periphery of the protective sheet 6, and provided in a flat portion parallel to the first surface 201 of the base member 27. The bonding portion 61 is bonded to the outer periphery of recess 20 of the case 2 by laser welding or ultrasonic welding. No pressure sensitive adhesive or adhesive is preferably used for bonding. Using any of these types of materials may cause dispersion in illuminability and may also cause the protective sheet 6 to turn yellow due to heat history.

The pressing portion 62 is a portion facing the pressure receiving portion 51 of the moving member 5. A circular portion forming the central portion of the protective sheet 6 constitutes the pressing portion 62. The pressing portion 62 is a flat portion parallel to the first surface 201 of the base member 27.

The intermediate portion 63 is provided between the bonding portion 61 and the pressing portion 62. The rest of the protective sheet 6, other than the bonding portion 61 and the pressing portion 62, constitutes the intermediate portion 63. That is to say, the rest, other than the pressing portion 62, of the part surrounded by the bonding portion 61 of the protective sheet 6 serves as the intermediate portion 63. At least part of the intermediate portion 63 is out of contact with the moving member 5. The intermediate portion 63 is sloped with respect to the first surface 201 of the base member 27 such that as the distance to the inner periphery (pressing portion 62) of the protective sheet 6 decreases, the height of the intermediate portion 63 as measured from the first surface 201 of the base member 27 increases (see FIGS. 7 and 8).

<Diffuse Reflection Layer>

The diffuse reflection layer 7 is a layer for diffusing and reflecting light. The diffuse reflection layer 7 is a layer in the color of, for example, white and milky white. The diffuse reflection layer 7 is arranged on the lower surface (second surface 202) of the case 2. In other words, the diffuse reflection layer 7 is arranged on the surface (second surface 202) opposite from the surface with the recess 20 of the case 2. In the upward/downward direction, the tapered surface 260 of the light reflection structure 26 and the diffuse reflection layer 7 are laid one on top of the other. The diffuse reflection layer 7 is a layer which generally has the same shape and dimensions as the contour of the case 2 in a top view. The diffuse reflection layer 7 is formed by, for example, welding a film, silk printing, or two-color molding. The diffuse reflection layer 7 lacks in light-transmitting property, and therefore, the members under the diffuse reflection layer 7 are hardly seen even when the diffuse reflection layer 7 is viewed from over the diffuse reflection layer 7. When the diffuse reflection layer 7 is formed, no pressure sensitive adhesive or adhesive is preferably used, either.

<Presser>

The presser 8 is arranged between the pressing portion 62 of the protective sheet 6 and the pressure receiving portion 51 of the moving member 5. The presser 8 has electrical insulation properties. The presser 8 is made of, for example, a resin. The presser 8 has the shape of a disk which is compressed in the upward/downward direction. The presser 8 is arranged on the moving member 5 such that the lower surface of the presser 8 is in contact with the upper surface of the pressure receiving portion 51. The upper surface of the presser 8 is bonded to the lower surface of the pressing portion 62 by laser welding and ultrasonic welding, for example.

The presser 8 transmits the operating force applied to the pressing portion 62 of the protective sheet 6 to the pressure receiving portion 51 of the moving member 5. Specifically, when the operating force is applied onto the pressing portion 62 from over the protective sheet 6, the operating force is transmitted to the pressure receiving portion 51 via the presser 8 and acts on the pressure receiving portion 51 from over the pressure receiving portion 51. This allows the pressure receiving portion 51 to be indirectly operated via the presser 8 by having the pressing portion 62 pressed.

<Illumination Action>

Next, the illumination action of the push switch 1 will be described.

Figure 6:
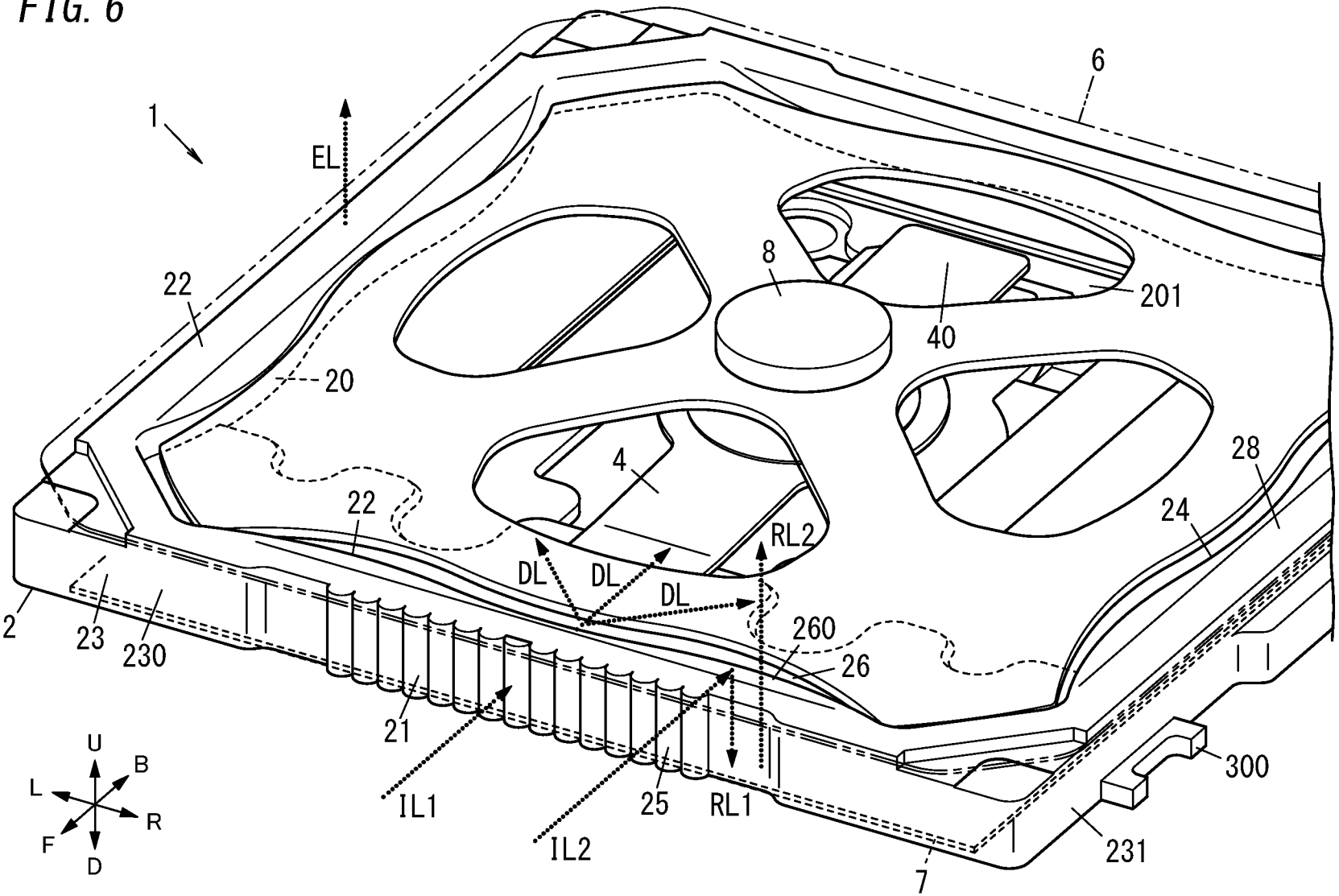
FIG. 6 is a perspective view showing, on a larger scale, main parts of the push switch.
Figure 10A:
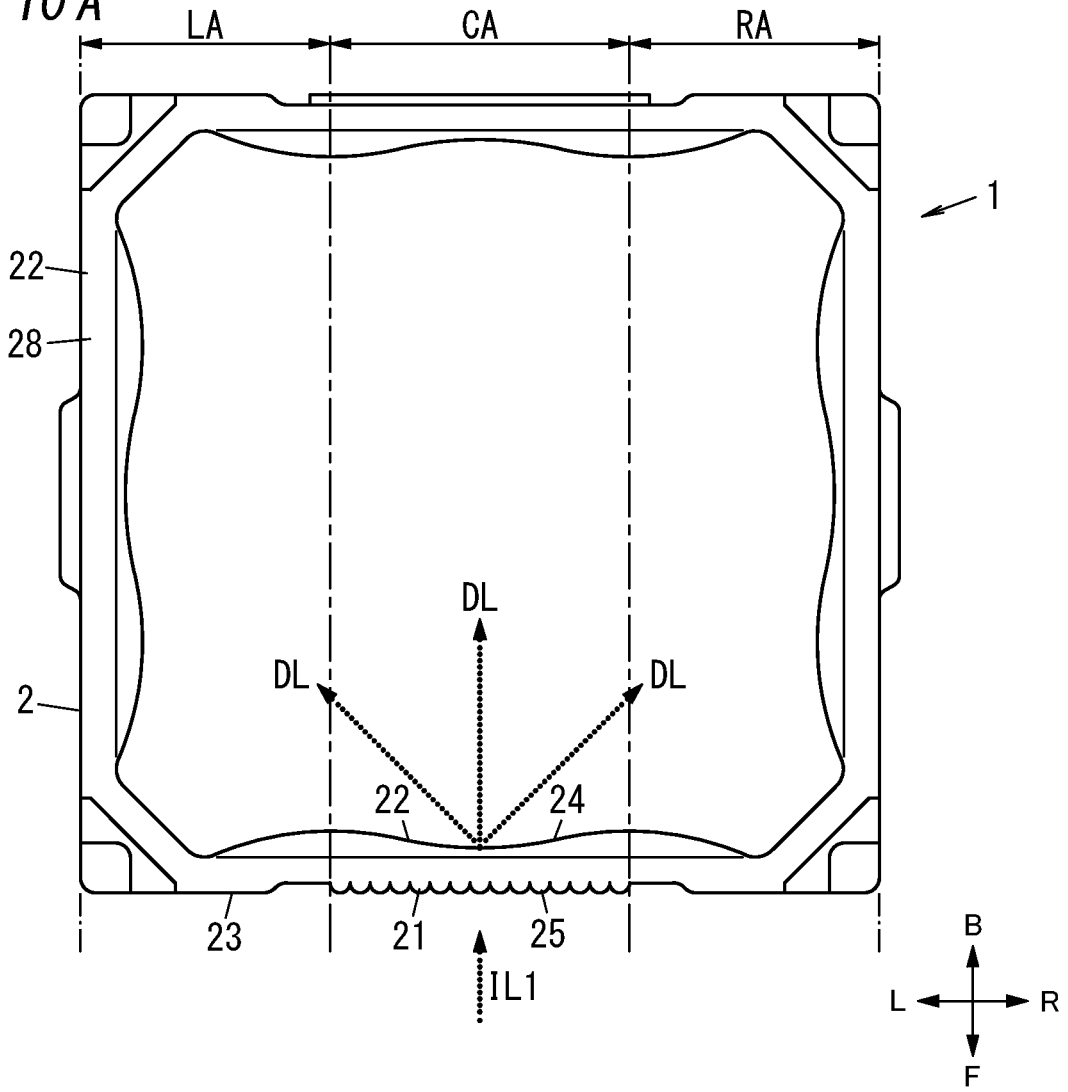
FIG. 10A is a schematic plan view showing where rays of incoming light (incident light) and diffused light travel with respect to a push switch according to the first embodiment.

As shown in FIGS. 6 and 10A, incoming light IL1 is incident (hereinafter referred to as "incident light IL1), sideways with respect to the outer side surface of the push switch 1, onto the light incident surface 21 that is provided as the outer surface 23 of the push switch 1. The incident light IL1 is diffused by the light diffusion structure 25 on the light incident surface 21. Then, diffused light DL emerges through the light emergent surface 22 which is provided as the inner surface 24 of the push switch 1. The diffused light DL spreads throughout a plane perpendicular to the upward/downward direction. In other words, the diffused light DL spreads throughout the entire case 2. The diffused light DL is visible through the protective sheet 6. In this manner, light is diffused over the entire plane through the case 2 to illuminate the entire case 2, thereby reducing uneven illumination. In addition, in this embodiment, the protective sheet 6 has a light-transmitting property. This allows increasing the illuminated area compared to a situation where the protective sheet 6 has no light-transmitting property. Note that FIG. 10A does not show some constituent elements to make the description more easily understandable.

The incident light IL1 that has entered through the light incident surface 21 is propagated, for example, by being totally reflected a number of times inside the case 2. Then, the incident light IL1 emerges, as emergent light EL, out of the case 2 through the light emergent surface 22 which is provided as the upper surface of the peripheral wall 28 (see FIGS. 6 and 10B). In this manner, the case 2 functions as a light guide member, which improves the illuminability of the push switch 1. Furthermore, in this embodiment, the emergent light EL upwardly emerges out of the case 2 in the direction in which the press operation is performed (i.e., the upward/downward direction). This allows the user to recognize an illuminated state of the push switch 1 more easily. Note that FIG. 10B does not show some constituent elements to make the description more easily understandable.

Figure 10B:
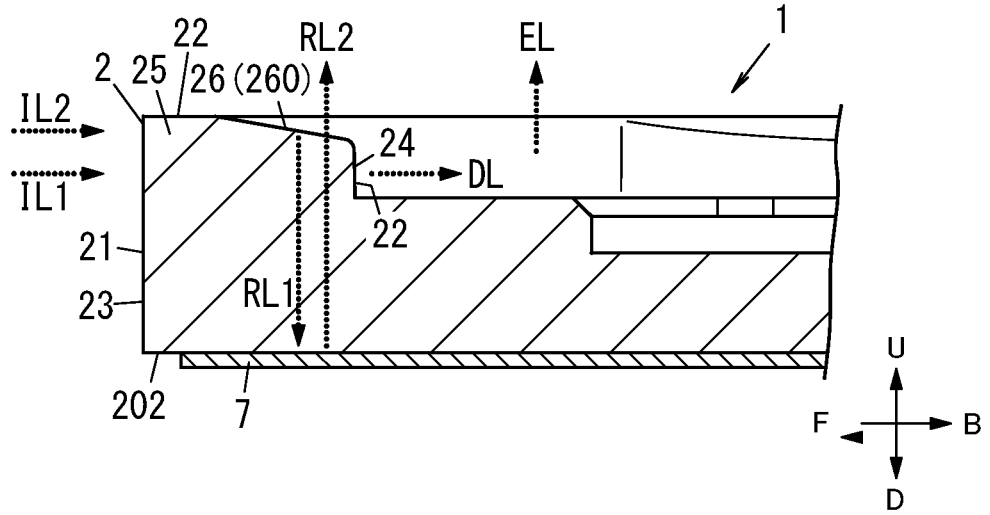
FIG. 10B is a schematic cross-sectional view showing where rays of incident light, diffused light, reflected light, and emergent light travel with respect to the push switch.

Meanwhile, as shown in FIG. 6, the incoming light IL2 is incident (hereinafter referred to as "incident light IL2"), sideways with respect to the outer side surface of the push switch 1, onto the light incident surface 21 that is provided as the outer surface 23 of the push switch 1. The incident light IL2 is reflected by the light reflection structure 26 of the light emergent surface 22. Specifically, as shown in FIG. 10B, the incident light IL2 is reflected downward by the tapered surface 260 of the light reflection structure 26 to turn into reflected light RL1. Then, the reflected light RL1 is upwardly reflected by the diffuse reflection layer 7 (not shown in FIG. 6) which is arranged on the lower surface (second surface 202) of the case 2 to turn into reflected light RL2. The reflected light RL2 is visible through the protective sheet 6 (not shown in FIG. 10B). In this manner, the tapered surface 260 may reflect the incident light in a direction different from the direction in which the incoming light has been incident. In addition, the illuminability is further improved by having the light which has returned from the opposite surface (second surface 202) diffused and reflected by the diffuse reflection layer 7. Moreover, when the push switch 1 is viewed from over the push switch 1, the presence of the diffuse reflection layer 7 allows hiding the board 100 and other members, which may be provided under the diffuse reflection layer 7.

Furthermore, the moving contact member 4 and the fixed contact member 3 which are housed in the case 2 have light reflectivity, thus enabling further improving the illuminability.

As a complement, it will be described briefly in this paragraph how the uneven illumination is caused. If the push switch 1 shown in FIG. 3 has no light incident surface 21 such as the one used in this embodiment, the incident light IL1 may be clearly seen in a central area CA. Meanwhile, the incident light IL1 is not seen clearly in a left area LA and a right area RA. In this manner, uneven illumination is caused. On the other hand, in this embodiment, the case 2 functions as a light guide member. This allows the diffused light DL to spread as shown in FIG. 10A through the plane perpendicular to the upward/downward direction, which makes the light clearly seen in not only the central area CA, but also the left area LA and the right area RA. As a result, the illuminability of the push switch 1 may be improved.

<Operation>

Next, the operation of the push switch 1 will be described with reference to FIGS. 7 and 8.

The push switch 1 is a normally open switch. When the push switch 1 is operated, press operation is performed on the pressing portion 62 of the protective sheet 6 to cause downward operating force to be applied onto the presser 8 via the pressing portion 62.

Figure 7:
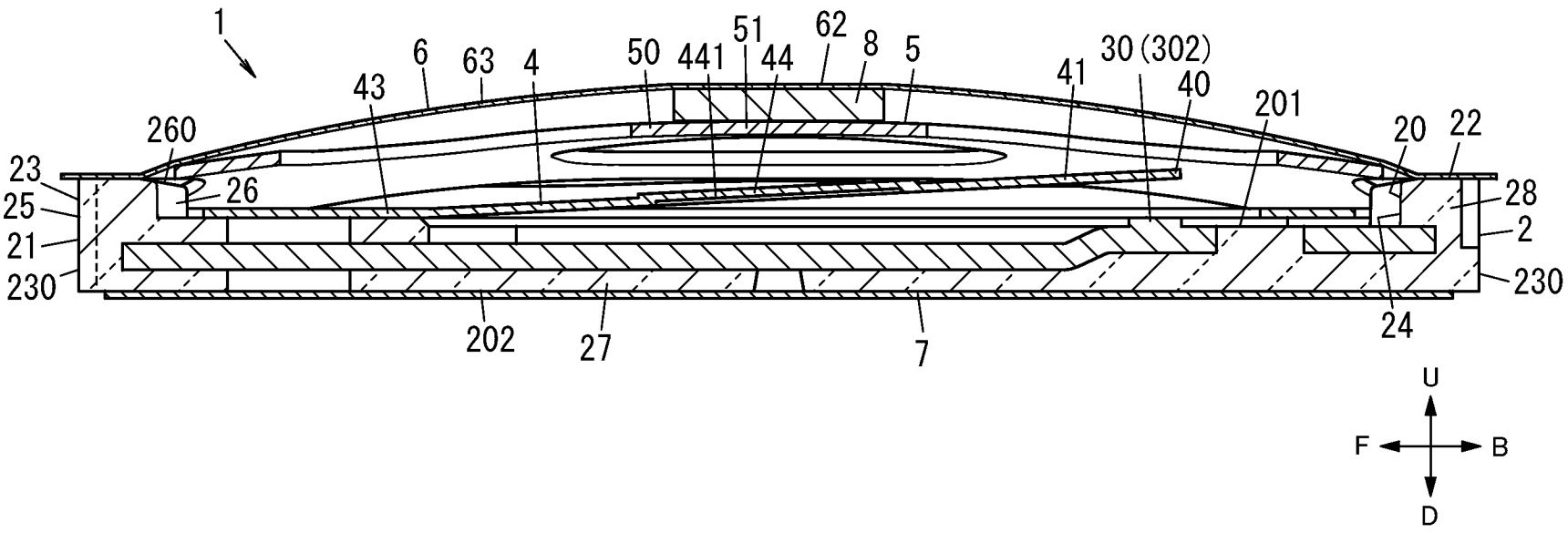
FIG. 7 is a schematic cross-sectional view of the push switch in a state where the push switch is not operated.
Figure 8:
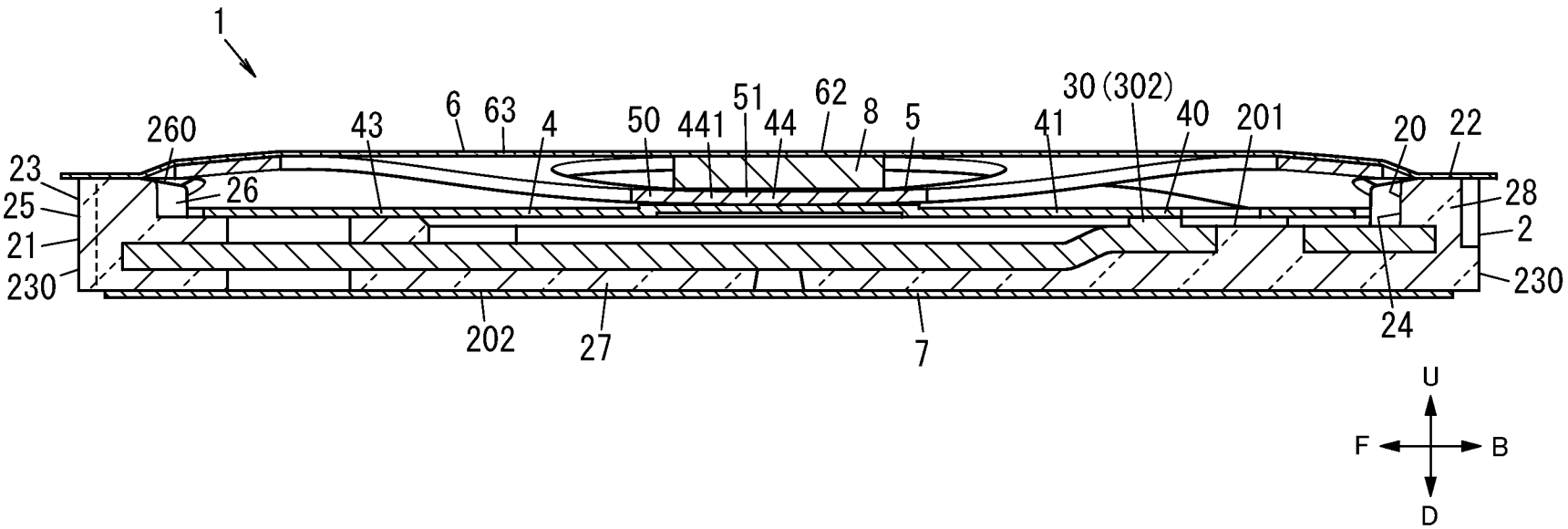
FIG. 8 is a schematic cross-sectional view of the push switch in a state where the push switch is operated.

First, when the operating force is applied onto the pressure receiving portion 51 via the presser 8 from over the push switch 1, the pressure receiving portion 51 is pushed toward the bottom surface (i.e., downward) of the recess 20 (first surface 201), thus gradually deforming the moving member 5 as shown in FIGS. 7 and 8. Then, when the magnitude of the operating force that acts on the pressure receiving portion 51 exceeds a predetermined value, the moving member 5 is significantly deformed due to buckling. At this time, the elastic force of the body portion 50 acting on the pressure receiving portion 51 changes sharply. As a result, through what is called "inversion operation" of the moving member 5, the body portion 50 is dynamically deformed with momentum into a curved dome shape so that the central portion (pressure receiving portion 51) thereof is convex downward. Consequently, the user performing the press operation on the push switch 1 is provided with clicking (a sense of click) as the moving member 5 is deformed.

As the moving member 5 is deformed, the lower surface of the pressure receiving portion 51 comes into contact with the projection 441 of the coupling portion 44 of the contact piece 41. Accordingly, the coupling portion 44 is pushed by the moving member 5, thus causing the moving contact 40 to move downward while flexing the coupling portion 44. When the moving contact 40 is displaced to a position where the moving contact 40 comes into contact with the second fixed contact 302 as shown in FIG. 8, the push switch 1 turns ON. In the state shown in FIG. 8, the contact piece 41 is parallel to the first surface 201 of the base member 27. In this state, the second fixed contact member 32 and the first fixed contact member 31 turn electrically conductive with each other.

Meanwhile, when the operating force is no longer applied to the pressure receiving portion 51 in a state where the body portion 50 is deformed into a convex down, curved dome shape, the central portion (pressure receiving portion 51) of the moving member 5 restores (i.e., is deformed again into), with the force of restitution of the moving member 5, its original convex up, curved dome shape. At this time, the elastic force of the body portion 50 acting on the pressure receiving portion 51 changes sharply. Therefore, the body portion 50 dynamically restores, with momentum, (i.e., is deformed into) its original shape (i.e., a dome shape of which the central portion is convex upward). Consequently, the user who has been performing the press operation on the push switch 1 is provided, when he or she stops performing the press operation, with clicking (the sense of click), as the moving member 5 is deformed. When the body portion 50 restores the convex up dome shape, the moving contact 40 at the tip portion of the contact piece 41 goes out of contact with the second fixed contact 302 as shown in FIG. 7, thereby turning the push switch 1 OFF. In this state, the second fixed contact member 32 and the first fixed contact member 31 turn electrically non-conductive with each other.

(1.2.2) Illuminated Switch Device

Figure 9A:
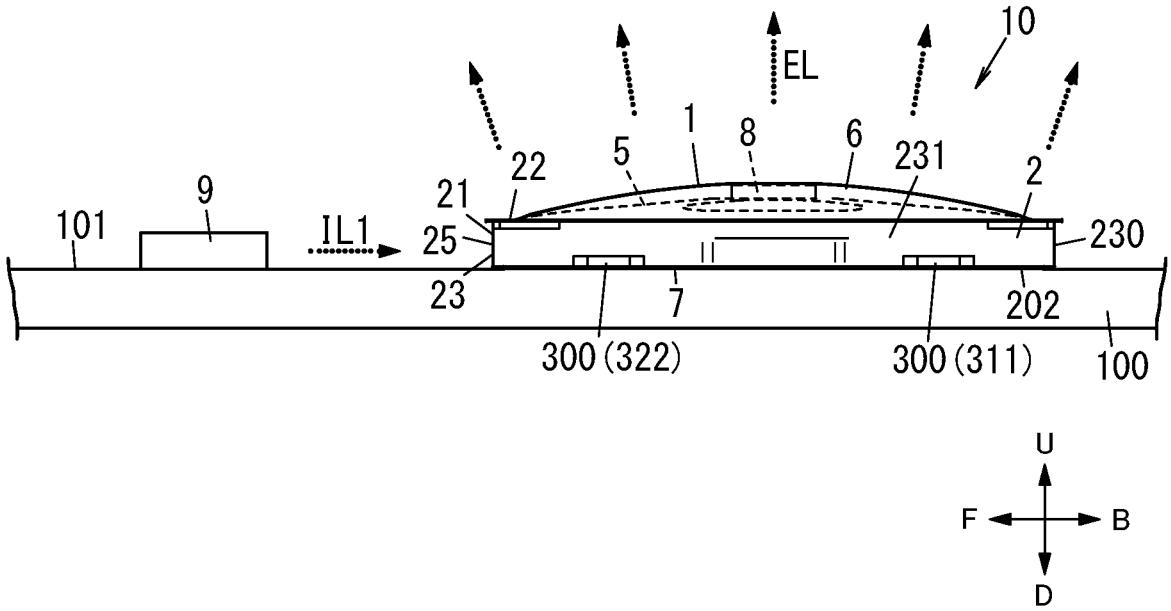
FIG. 9A is a schematic side view of an illuminated switch device according to a first embodiment.
Figure 9B:
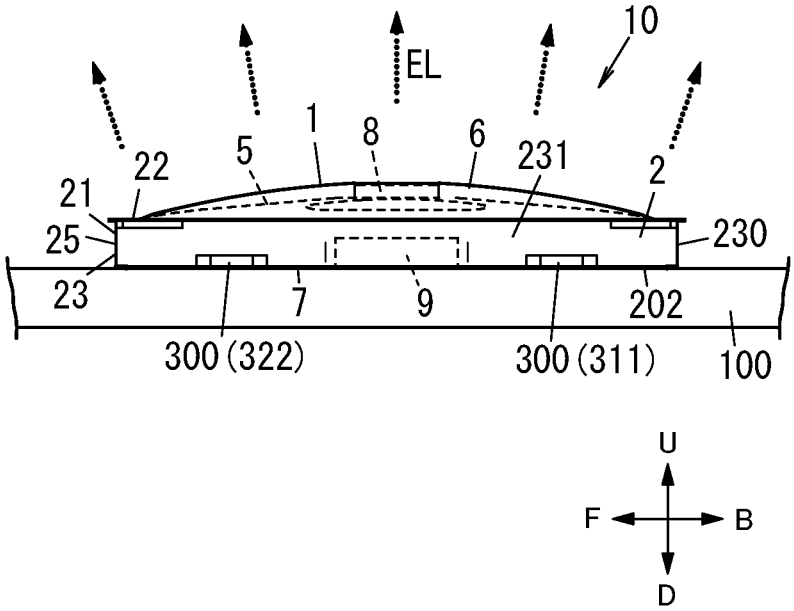
FIG. 9B is a schematic side view of an illuminated switch device according to a second embodiment.

Next, an illuminated switch device 10 according to this embodiment will be described. As shown in FIG. 9, the illuminated switch device 10 includes the board 100, the push switch 1, and a light source 9.

The board 100 has electrical insulation properties. The board 100 may be, for example, a printed circuit board or a flexible printed circuit board. The board 100 has a principal surface 101. On the principal surface 101, a conductive member (not shown) for mounting the push switch 1 and the light source 9 thereon is provided.

The push switch 1 is mounted on the principal surface 101 of the board 100. Specifically, the terminals 300 of the push switch 1 are mechanically bonded and electrically connected, by soldering, to the conductive member on the principal surface 101.

The light source 9 is mounted on the principal surface 101 of the board 100 to be spaced from the push switch 1. In this manner, the light source 9 may be arranged outside of the case 2.

The light source 9 is arranged sideways with respect to the push switch 1. The light source 9 emits light toward the light incident surface 21 of the push switch 1. The light source 9 may be, for example, a light emitting element (what is called a "side emitting LED").

The light incident surface 21 of the push switch 1 and the light source 9 face each other. The light incident surface 21 is provided as one of the surfaces 230 with no terminals. This reduces the chances of the terminals 300 posing an obstacle when the push switch 1 and the light source 9 are mounted on the principal surface 101 to be arranged side by side. That is to say, the light source 9 may be easily arranged with respect to the light incident surface 21.

In the illuminated switch device 10 as well as the illumination action described above, incoming light IL1 emitted from the light source 9 enters the case 2 through the light incident surface 21 of the push switch 1, and then the light emerges, as emergent light EL, out of the case 2 through the light emergent surface 22. In this manner, the case 2 functions as a light guide member, thereby improving the illuminability of the illuminated switch device 10.

(2) Second Embodiment

Next, a push switch 1 according to a second embodiment will be described with reference to the drawings. In the following description, any constituent element of this second embodiment, having the same function as a counterpart of the first embodiment described above, will be designated by the same reference numeral as that counterpart's, and a detailed description thereof will be omitted herein.

Figure 11:
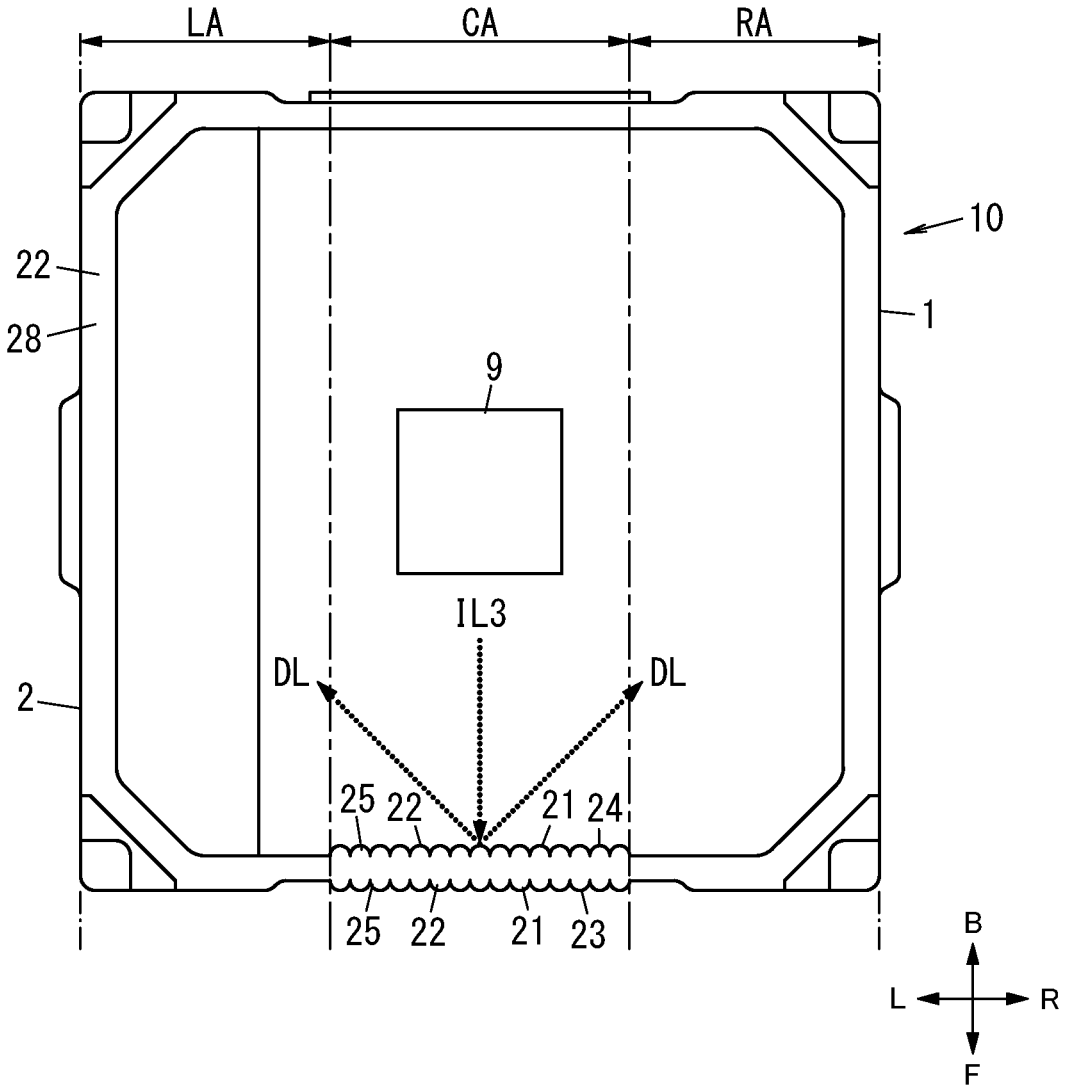
FIG. 11 is a schematic plan view showing where rays of incoming light (incident light) and diffused light travel with respect to a push switch according to the second embodiment.

As shown in FIG. 11, in the push switch 1 according to the second embodiment, the light incident surface 21 is provided on each of the outer surface 23 and the inner surface 24 of the case 2, which is a difference from the push switch 1 according to the first embodiment. Moreover, in the second embodiment, the light diffusion structure 25 is provided for each of the two light incident surfaces 21 on the outer surface 23 and the inner surface 24. Note that FIG. 11 does not show some constituent elements to make the description more easily understandable.

Moreover, as shown in FIG. 11, an illuminated switch device 10 according to the second embodiment includes a light source 9 inside the push switch 1, which is another difference from the illuminated switch device 10 of the first embodiment. The light source 9 emits light IL3 toward the light incident surface 21 on the inner surface 24 of the case 2. The light IL3 that has entered the case 2 (hereinafter referred to as "incident light IL3") is diffused by the light diffusion structure 25 on the light incident surface 21. Then, diffused light DL emerges through the light emergent surface 22 on the inner surface 24. As can be seen, the light incident surface 21 may also serve as the light emergent surface 22. The diffused light DL spreads throughout a plane perpendicular to the upward/downward direction. In other words, the diffused light DL spreads throughout the entire case 2. The diffused light DL is visible through the protective sheet 6. In this manner, light is diffused over the entire plane through the case 2 to illuminate the entire case 2. Consequently, uneven illumination may be reduced.

Furthermore, in the illuminated switch device 10 according to the second embodiment as well, the incident light IL3 that has entered through the light incident surface 21 is propagated, for example, by being totally reflected a number of times inside the case 2. Then, the incident light IL3 emerges, as emergent light EL, out of the case 2 through the light emergent surface 22 which is provided as the upper surface of the peripheral wall 28 (see FIG. 9B). In this manner, the case 2 functions as a light guide member, thereby improving the illuminability of the push switch 1. Furthermore, in this embodiment, the emergent light EL also upwardly emerges out of the case 2 in the direction in which the press operation is performed (i.e., the upward/downward direction). This allows the user to recognize an illuminated state of the push switch 1 more easily. Note that the size and the arrangement position of the light source 9 are defined, for example, on the condition that the size and the arrangement position do not pose an obstacle to the press operation on the push switch 1.

(3) Variations

The push switch according to the first and second embodiments is configured to illuminate the entire case 2. Alternatively, the push switch may also be configured to illuminate only the edge of the case 2 (specifically, the upper surface of the peripheral wall 28).

In the push switch 1 according to the second embodiment, the light incident surface 21 is provided for each of the outer surface 23 and the inner surface 24 of the case 2. Alternatively, the light incident surface 21 may only be provided for the inner surface 24 and does not have to be provided for the outer surface 23.

In the second embodiment, the light diffusion structure 25 is provided for each of the two light incident surfaces 21 of the outer surface 23 and the inner surface 24. Alternatively, the light diffusion structure 25 may be provided for only the inner surface 24 and does not have to be provided for the outer surface 23. Conversely, the light diffusion structure 25 may be provided for only the outer surface 23 and does not have to be provided for the inner surface 24.

In the push switch 1 according to the second embodiment, the light diffusion structure 25 arranged on the outer surface 23 and the light diffusion structure 25 arranged on the inner surface 24 are provided on the front and back sides in the forward/backward direction (see FIG. 11). However, the two light diffusion structures 25 do not have to be provided on the front and back sides, respectively. That is to say, another light diffusion structure 25 does not have to be provided for the inner surface 24 that is the opposite side (back side) of the outer surface 23 on which the light diffusion structure 25 is provided. Likewise, another light diffusion structure 25 does not have to be provided for the outer surface 23 that is the opposite side (front side) of the inner surface 24 on which the light diffusion structure 25 is provided.

In the illuminated switch devices 10 according to the first and second embodiments, the base member 27 and the board 100 of the push switch 1 are separately provided. Alternatively, the base member 27 itself of the push switch 1 may form part of the board 100.

In the illuminated switch device 10 according to the second embodiment, the light source 9 is arranged inside the push switch 1. However, another light source 9 may be additionally arranged outside of the push switch 1.

(4) Recapitulation

As can be seen from the foregoing description of the first and second embodiments and their variations, the present disclosure has the following aspects. In the following description, reference signs are inserted in parentheses just for the sake of clarifying correspondence in constituent elements between the following aspects of the present disclosure and the exemplary embodiments described above.

A push switch (1) according to a first aspect includes a case (2), a fixed contact member (3), a moving contact member (4), and a protective sheet (6). The case (2) has a first surface (201) provided with a recess (20) and a second surface (202) opposite from the first surface (201). The fixed contact member (3) includes a fixed contact (30) arranged in the recess (20) and a terminal (300) arranged on an outer surface of the case (2). The moving contact member (4) is arranged in the recess (20) and includes a moving contact (40) that comes into contact with the fixed contact (30) when the push switch (1) is subjected to a press operation. The protective sheet (6) covers the recess (20). The case (2) has a light-transmitting property. The case (2) has a light incident surface (21) and a light emergent surface (22). The light incident surface (21) is a surface on which light is incident. The light emergent surface (22) is a surface through which at least part of the light that has entered through the light incident surface (21) emerges.

This aspect allows improving the illuminability of the push switch (1) by having the case (2) function as a light guide member.

In a push switch (1) according to a second aspect, which may be implemented in conjunction with the first aspect, the light incident surface (21) is provided as an outer surface (23) of the case (2).

This aspect allows arranging a light source (9) outside of the case (2).

In a push switch (1) according to a third aspect, which may be implemented in conjunction with the second aspect, the outer surface (23) of the case (2) is a surface connecting the first surface (201) and the second surface (202) of the case (2).

This aspect allows light to be incident between the first surface (201) and the second surface (202).

In a push switch (1) according to a fourth aspect, which may be implemented in conjunction with the second or third aspect, the outer surface (23) of the case (2) includes a surface (231) with the terminal and a surface (230) without the terminal. The surface (231) with the terminal is provided with the terminal (300). The surface (230) without the terminal is not provided with the terminal (300). The light incident surface (21) is provided as the surface (230) without the terminal.

This aspect allows the light source (9) to be easily arranged with respect to the light incident surface (21).

In a push switch (1) according to a fifth aspect, which may be implemented in conjunction with any one of the first to fourth aspects, the light incident surface (21) is provided on an inner surface (24) of the recess (20) of the case (2).

This aspect allows arranging the light source (9) inside of the case (2).

In a push switch (1) according to a sixth aspect, which may be implemented in conjunction with any one of the first to fifth aspects, the case (2) has a light diffusion structure (25) provided for the light incident surface (21). The light diffusion structure (25) causes the light to diffuse within a plane perpendicular to a direction in which the press operation is performed.

This aspect allows reducing uneven illumination by causing the light to diffuse over the entire plane throughout the case (2) and thereby illuminate the case (2) in its entirety.

In a push switch (1) according to a seventh aspect, which may be implemented in conjunction with any one of the first to sixth aspects, the case (2) has a light reflection structure (26) provided on the light emergent surface (22). The light reflection structure (26) reflects the light in a direction parallel to a direction in which the press operation is performed.

This aspect allows further improving the illuminability.

In a push switch (1) according to an eighth aspect, which may be implemented in conjunction with the seventh aspect, the light reflection structure (26) has a tapered surface (260). The tapered surface (260) is sloped with respect to the direction in which the press operation is performed.

According to this aspect, the tapered surface (260) may reflect the light in a direction different from the direction in which the incoming light has been incident.

In a push switch (1) according to a ninth aspect, which may be implemented in conjunction with any one of the first to eighth aspects, the protective sheet (6) has a light-transmitting property.

This aspect allows increasing an illuminated area compared to a situation where the protective sheet (6) has no light-transmitting property.

A push switch (1) according to a tenth aspect, which may be implemented in conjunction with any one of the first to ninth aspects, further includes a diffuse reflection layer (7). The diffuse reflection layer (7) is arranged on the second surface (202) of the case (2). The diffuse reflection layer (7) diffuses and reflects light.

This aspect allows further improving the illuminability by making the diffuse reflection layer (7) diffuse and reflect the light which has emerged from the opposite surface (202).

In a push switch (1) according to an eleventh aspect, which may be implemented in conjunction with any one of the first to tenth aspects, the light emergent surface (22) is provided for the first surface (201) of the case (2).

This aspect allows the user to recognize an illuminated state of the push switch (1) more easily.

In a push switch (1) according to a twelfth aspect, which may be implemented in conjunction with any one of the first to eleventh aspects, at least part of the moving contact member (4) and at least part of the fixed contact member (3) have light reflectivity.

This aspect allows further improving the illuminability by having the light reflected.

An illuminated switch device (10) according to a thirteenth aspect includes the push switch (1) according to any one of the first to twelfth aspects and a light source (9). The light source (9) emits light toward the light incident surface (21) of the push switch (1).

This aspect allows improving the illuminability of the push switch (1) by having the case (2) function as a light guide member.

REFERENCE SIGNS LIST

1 Push Switch
10 Illuminated Switch Device
2 Case
20 Recess
21 Light Incident Surface
22 Light Emergent Surface
23 Outer Surface
24 Inner Surface
25 Light Diffusion Structure
26 Light Reflection Structure
260 Tapered Surface
201 First Surface
202 Second Surface
230 Surfaces without Terminals
231 Surfaces with Terminals
3 Fixed Contact Member
30 Fixed Contact
300 Terminal
4 Moving Contact Member
40 Moving Contact
6 Protective Sheet
7 Diffuse Reflection Layer
9 Light Source

The invention claimed is:

1. A push switch comprising:
a case having a first surface provided with a recess and a second surface opposite from the first surface;
a fixed contact member including a fixed contact arranged in the recess and a terminal arranged on an outer surface of the case;
a moving contact member arranged in the recess and including a moving contact configured to come into contact with the fixed contact when the push switch is subjected to a press operation; and
a protective sheet covering the recess,
the case having a light-transmitting property and including:
a light incident surface on which light is incident; and
a light emergent surface through which at least part of the light that has entered through the light incident surface emerges,
wherein the light incident surface is provided as an outer surface of the case, and
the outer surface of the case is a surface connecting the first surface and the second surface of the case.

2. The push switch of claim 1, wherein
the outer surface of the case includes a surface with the terminal and a surface without the terminal, and
the light incident surface is provided as the surface without the terminal.

3. The push switch of claim 1, wherein the light incident surface is provided on an inner surface of the recess of the case.

4. The push switch of claim 1, wherein the case has a light diffusion structure provided for the light incident surface and configured to cause the light to diffuse within a plane perpendicular to a direction in which the press operation is performed.

5. The push switch of claim 1, wherein the case has a light reflection structure provided on the light emergent surface and configured to reflect the light in a direction parallel to a direction in which the press operation is performed.

6. The push switch of claim 5, wherein the light reflection structure has a tapered surface which is sloped with respect to the direction in which the press operation is performed.

7. The push switch of claim 1, wherein the protective sheet has a light-transmitting property.

8. The push switch of claim 1, further comprising a diffuse reflection layer arranged on the second surface of the case and configured to diffuse and reflect light.

9. The push switch of claim 1, wherein the light emergent surface is provided for the first surface of the case.

10. The push switch of claim 1, wherein at least part of the moving contact member and at least part of the fixed contact member have light reflectivity.

11. An illuminated switch device comprising:
the push switch of claim 1; and
a light source configured to emit light toward the light incident surface of the push switch.

12. A push switch comprising:
a case having a first surface provided with a recess and a second surface opposite from the first surface;
a fixed contact member including a fixed contact arranged in the recess and a terminal arranged on an outer surface of the case;
a moving contact member arranged in the recess and including a moving contact configured to come into contact with the fixed contact when the push switch is subjected to a press operation; and
a protective sheet covering the recess,
the case having a light-transmitting property and including:
a light incident surface on which light is incident; and
a light emergent surface through which at least part of the light that has entered through the light incident surface emerges,
the light incident surface being provided as an outer surface of the case,
the outer surface of the case including a surface with the terminal and a surface without the terminal,
the light incident surface being provided as the surface without the terminal.

* * * * *